United States Patent [19]

Lawrence et al.

[11] Patent Number: 4,991,596

[45] Date of Patent: Feb. 12, 1991

[54] SMOKING ARTICLE

[75] Inventors: Brian M. Lawrence; Milly M. L. Wong; Thomas A. Perfetti; Thomas L. Gentry, all of Winston-Salem; Alvaro Gonzalez-Parra; Jerry W. Lawson, both of Clemmons; Gary R. Shelar, Greensboro; Gary W. Worrell, Tobaccoville, all of N.C.

[73] Assignee: R. J. Reynolds Tobacco Company, Winston-Salem, N.C.

[21] Appl. No.: 378,551

[22] Filed: Jul. 11, 1989

[51] Int. Cl.[5] ..... A24D 1/00; A24D 1/02; A24D 1/18

[52] U.S. Cl. ..... 131/194; 131/335; 131/273; 131/275

[58] Field of Search ..... 131/194, 335, 360, 275, 131/361, 364, 273

[56] References Cited

U.S. PATENT DOCUMENTS

| | | |
|---|---|---|
| 2,907,686 | 10/1959 | Siegel . |
| 3,258,015 | 6/1966 | Ellis et al. . |
| 3,356,094 | 12/1967 | Ellis et al. . |
| 3,369,551 | 2/1968 | Carroll . |
| 3,516,417 | 6/1970 | Moses . |
| 3,550,598 | 12/1970 | McGlumphy et al. . |
| 4,340,072 | 7/1982 | Bolt et al. . |
| 4,474,191 | 10/1984 | Steiner . |
| 4,708,151 | 11/1987 | Shelar . |
| 4,714,082 | 12/1987 | Banerjee et al. . |
| 4,719,929 | 1/1988 | Breckwoldt . |
| 4,756,318 | 7/1988 | Clearman et al. . |
| 4,771,795 | 9/1988 | White et al. . |
| 4,793,365 | 12/1988 | Sensabaugh, Jr. et al. . |
| 4,807,648 | 2/1989 | Breckwoldt . |
| 4,827,950 | 5/1989 | Banerjee et al. . |
| 4,858,630 | 8/1989 | Banerjee et al. . |
| 4,893,639 | 1/1990 | White . |

FOREIGN PATENT DOCUMENTS

| | | |
|---|---|---|
| 305788 | 3/1989 | European Pat. Off. . |
| 910451 | 11/1962 | United Kingdom . |

OTHER PUBLICATIONS

Tobacco Encyclopedia, edit. by Voges, p. 125, p. 180, pp. 411–414, TJI (1984).

*Tobacco Flavoring For Smoking Products,* (1972) Leffingwell et al., pp. 10, 11, and 52–60.

*Primary Examiner*—V. Millin

[57] ABSTRACT

A smoking article includes a short, combustible, carbonaceous fuel element in a heat exchange relationship with a substrate carrying glycerin, tobacco extract, and a portion of an essential oil gland bearing plant. For example, fragments of cinnamon bark, lovage root, chamomile flowers or cardamon physically separate from the fuel element provide for a controlled release of a flavor profile during use of the smoking article. Heat provided by the burning fuel element acts to release essential oils from the glands to provide a complex flavor and aroma profile. The smoking article is capable of providing the user with many of the pleasures of smoking by heating but not necessarily burning tobacco.

29 Claims, 1 Drawing Sheet

SMOKING ARTICLE

BACKGROUND OF THE INVENTION

The present invention relates to smoking articles such as cigarettes and, in particular, to those smoking articles having a fuel element, a physically separate aerosol generating means, and a mouthend piece. Smoking articles of the present invention include an aerosol generating means which is capable of producing substantial quantities of flavorful aerosol for delivery to the user. Preferred smoking articles of the present invention are capable of providing the user with the pleasures of smoking (e.g., smoking taste, feel, satisfaction, and the like), by heating but not burning tobacco.

Cigarettes, cigars and pipes are popular smoking articles which use tobacco in various forms. Many smoking products and smoking articles have been proposed through the years as improvements upon, or alternatives to, the various popular smoking articles.

Many tobacco substitute smoking materials have been proposed, and a substantial listing of such materials can be found in U.S. Pat. No. 4,079,742 to Rainer et al. Tobacco substitute smoking materials having the tradenames Cytrel and NSM were introduced in Europe during the 1970's as partial tobacco replacements, but did not realize any long-term commercial success.

Numerous references have proposed smoking articles which generate flavored vapor and/or visible aerosol. See, for example, U.S. Pat. No. 2,907,686 to Siegel; U.S. Pat. Nos. 3,258,015 and 3,356,094 to Ellis et al; U.S. Pat. No. 3,516,417 to Moses; U.S. Pat. No. 4,340,072 to Bolt and U.S. Pat. No. 4,474,191 to Steiner. However, despite decades of interest and effort, no one had successfully developed a smoking article which provided the sensations associated with cigarette, cigar or pipe smoking, without delivering considerable quantities of incomplete combustion and pyrolysis products.

Recently, however, in European Patent Publication Nos. 212,234 and 277,519; and U.S. Pat. Nos. 4,708,151; 4,714,082; 4,756,318 and 4,793,365; assigned to R. J. Reynolds Tobacco Co., there are described smoking articles which are capable of providing the sensations associated with cigarette and pipe smoking, without the necessity of burning tobacco and without delivering considerable quantities of incomplete combustion products. Such smoking articles employ an aerosol generating means, physically separate from and in a heat exchange relationship with a fuel element. The aerosol generating means normally includes tobacco in the form of tobacco extracts; tobacco flavor modifiers such as levulinic acid and glucose pentaacetate; and tobacco flavoring agents such as sugars, and cocoa and licorice powders and extracts; and other aerosol forming substances such as glycerin. It would be highly desirable to provide for such smoking articles unique natural flavor packages employing certain natural flavor materials.

SUMMARY OF THE INVENTION

The present invention relates to smoking articles which include a combustible fuel element and a physically separate aerosol generating means in a heat exchange relationship with the fuel element. The aerosol generating means includes a flavor package, and in particular, a natural flavor release package. The natural flavor release package provides for controlled release of a flavor profile during use of the smoking article, and includes a portion (i.e., parts or fragments) of an essential oil gland bearing plant. The term "physically separate" in referring to the fuel element and aerosol generating means is meant that aerosol forming substances of the aerosol generating means are not mixed with or are not a part of the fuel element.

Preferred smoking articles of the present invention employ a short, carbonaceous fuel element having a length less than about 30 mm prior to use, and an aerosol generating means longitudinally disposed behind the fuel element (i.e., towards the mouthend of the smoking article relative to the fuel element). Normally, the aerosol generating means is in a conductive heat exchange relationship with the fuel element. A resilient insulating member, normally at least about 0.5 mm thick, preferably circumscribes the periphery of the fuel element. Preferred smoking articles also include a mouthend piece, normally having the form of a filter plug segment. Preferred filter segments exhibit low filtration efficiencies so as to minimize interference with the passage of aerosol from the aerosol generating means to the mouth of the smoker during draw (i.e., upon use). Also preferred are smoking articles which employ a segment of flavor-containing material, such as a gathered or pleated tobacco paper or menthol-containing pleated carbon filled sheet between the aerosol generating means and the filter segment.

Preferred cigarette smoking articles of the present invention include a roll or charge of tobacco, normally in cut filler form, wrapped in a wrapping material such as paper, thereby forming a tobacco rod. The tobacco can be in a processed form such as volume expanded cut filler or aqueously extracted/volume expanded cut filler. A heat conductive or otherwise heat resistant container or housing normally is located in a passage which extends longitudinally through the tobacco rod. The short fuel element is located at one end of the container, and the mouthend piece is located at the other end of the container. The container contains parts or fragments of at least one essential oil gland bearing plant as well as other aerosol forming materials. Other aerosol forming materials can include tobacco such as tobacco dust, spray dried tobacco extracts or tobacco essences; and tobacco flavoring agents such as sugars, licorice and cocoa. Other aerosol forming materials also include polyhydric alcohols, such as glycerin, propylene glycol and triethylene glycol, which vaporize to produce a visible, "smoke-like" aerosol. The aerosol forming materials within the container typically are carried by a substrate such as alumina beads or a fibrous carbon material. In certain circumstances, the parts or fragments of one or more essential oil gland bearing plants are carried by the substrate; while in other circumstances, relatively large fragments of one or more essential oil gland bearing plants can act as a substrate for the other aerosol forming materials.

The use of controlled natural flavor release packages in combination with the previously described smoking articles provides the skilled artisan with an efficient and effective method for manufacturing smoking articles which heat but do not necessarily burn tobacco, and which provide a flavorful and aromatic aerosol. In particular, heat generated by the burning fuel element of the smoking article during use causes the natural flavor package (which is in a heat exchange relationship with the fuel element) to release flavorful substances. Hence, flavors released from the natural flavor package upon use of the smoking article yield a complex flavor and aroma profile characteristic of a plurality of natural flavoring substances (i.e. essential oils). However, due to the natural form in which the essential oils are employed according to the present invention, migration of many of the flavorful substances of the flavor package upon storage of the smoking article is minimized or non-existent, while desirable delivery of the flavorful essential oils is provided upon exposure to elevated temperatures during use of the smoking article.

As used herein, and only for purposes of the present invention, "aerosol" is defined to include vapors, gases, particles, and the like, both visible and invisible, and essentially those components perceived by the user to be "smoke-like," generated by the action of heat from the burning fuel element upon substances contained within the aerosol generating means, or elsewhere in the article.

The smoking articles of the present invention are described in greater detail in the accompanying drawings and the detailed description of the invention which follows.

DETAILED DESCRIPTION OF THE PREFERRED EMBODIMENTS

Figure 1:
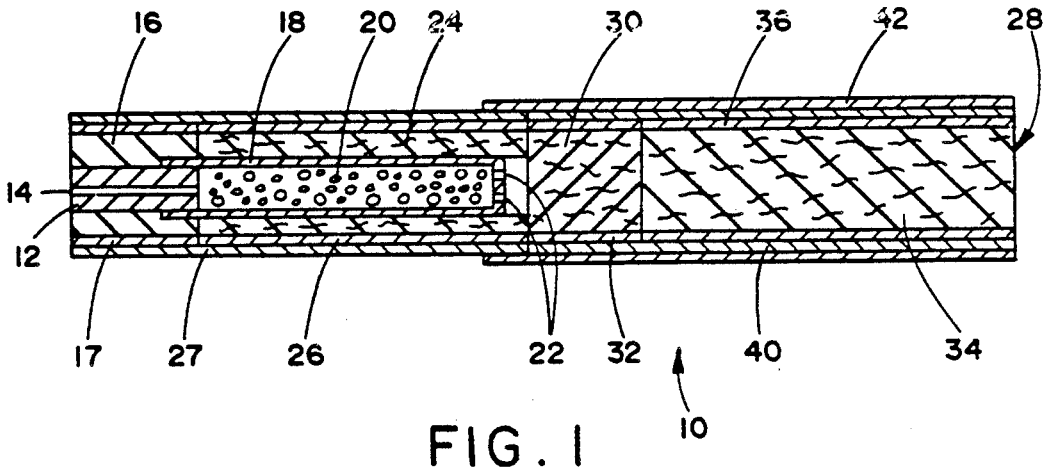
FIG. 1 is a longitudinal, sectional view of one preferred cigarette representative of the present invention.
Figure 1A:
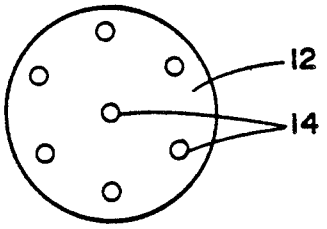
FIGS. 1A and 1B are cross sectional views of the embodiment shown in FIG. 1, taken along lines 1—1 in FIG. 1.
Figure 1B:
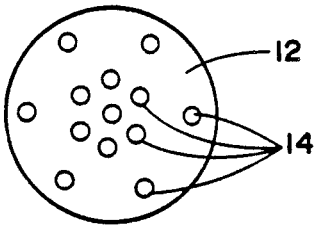

Referring to FIG. 1, cigarette 10 includes a small, carbonaceous fuel element 12 having a plurality of passageways 14 therethrough, preferably arranged as shown in FIG. 1A and more preferably as shown in FIG. 1B. The fuel element 12 is shown surrounded or circumscribed by a resilient jacket of insulating fibers 16, such as glass fibers. The insulating fibers 16 are, in turn, circumscribed by a wrapper 17.

A heat resistant housing or container 18 is longitudinally disposed behind the fuel element 12. The container 18 normally is manufactured from a heat conductive material such as aluminum. Within the container is positioned a granular or particulate substrate 20, although other forms of substrates, such as heat resistant carbon fibers and densified tobacco pellets can be employed. The substrate 20 acts as a carrier for the flavor package, particularly when the flavor package is in finely divided form. The flavor package includes portions of essential oil gland bearing plants as well as other aerosol forming substances such as glycerin, tobacco flavoring agents, and tobacco in forms such as tobacco dust, finely divided tobacco laminae and tobacco extracts. The container 18 has an open end into which the fuel element 12 is inserted, and a closed end having one or more slit-like passageways or slots 22 forming openings therein. Passageways 22 are dimensioned to contain the substrate within the container, while permitting the passage of vaporized aerosol forming materials therethrough.

The container 18 is positioned within, and circumscribed by, a roll of tobacco 24. Normally, the roll of tobacco is a charge of cut filler; although other forms of tobacco, such as extruded tobacco, can be employed. Typically, cut filler includes strands or shreds of tobacco laminae, strands or shreds of reconstituted tobacco, volume expanded strands or shreds of tobacco laminae and processed (e.g., aqueously extracted) tobacco laminae, processed tobacco stems, and the like, as well as blends thereof. The roll of tobacco 24 is circumscribed by wrapping material 26, such as cigarette paper, thereby forming a tobacco rod having the container 18 located therein.

The fuel element 12, which is peripherally circumscribed by the insulating jacket 16 and wrapper 17, and the tobacco rod are overwrapped by a circumscribing outer wrapper 27. See, U S. Pat. No. 4,779,631 to Durocher et al and European Patent Application No. 304,766, which are incorporated herein by reference. If desired, an amount of essential oil gland bearing plant can be incorporated physically separate from the fuel, but in a heat exchange relationship with the fuel, within the insulating jacket 16, in order to provide a pleasant sidestream aroma upon use of the cigarette.

At the mouth end of the tobacco rod is located a mouthend piece 28. The mouthend piece normally includes (i) a segment of flavor-containing material 30 (e.g., tobacco paper or carbon filled sheet bearing a flavor such as menthol) wrapped in a paper wrapper 32; and (ii) a filter plug including a segment of filter material 34 (e.g., a pleated or gathered sheet of non-woven thermoplastic fibers) wrapped in a paper wrapper 36. An apparatus suitable for manufacturing such segments from respective webs of sheet-like materials is described in U.S. Pat. No. 4,807,809 to Pryor et al, which is incorporated herein by reference. See, also, European Patent Application No. 304,759. The two segments are overwrapped and maintained in place by a circumscribing paper 40. To the extent that the segment of flavor-containing material 30 is in a heat exchange relationship with the fuel element (e.g., by conduction of heat from the container 18 or by convection by heated air) the flavor-containing material can have incorporated therein parts of fragments of essential oil gland bearing plants.

The segment which includes the fuel element and tobacco rod is positioned in an abutting end-to-end relationship with the mouthend piece, and the two segments are held in place by tipping material 42 which circumscribes the mouthend piece as well as an adjacent region of the tobacco rod.

Smoking articles of the present invention, and various components thereof, are described in greater detail in U.S. Pat. Nos. 4,771,795 to White et al; 4,714,082 to Banerjee et al; 4,756,318 to Clearman et al; 4,793,365 to Sensabaugh et al and 4,827,950 to Banerjee et al; and European Patent Application Nos. 212,234; 277,519 and 305,788; which are incorporated herein by reference. See, also, U.S. Pat. No. 4,819,665 to Roberts et al, which is incorporated herein by reference. Methods for making suitable fuel elements are set forth in European Patent Publication No. 236,992, which is incorporated herein by reference. Apparatus suitable for assembling preferred substrate-filled cartridges having fuel elements inserted into one end thereof is described in European Patent Publication No. 257,230, which is incorporated herein by reference. Apparatus suitable for manufacturing preferred smoking articles of the present invention are described in European Patent Publication Nos. 299,260 and 299,272, which are incorporated herein by reference.

As used herein, the term "flavor package" is meant to refer to a combination of substances which provide a flavor and aroma profile upon use of a smoking article of the present invention. In particular, flavor and aroma substances of the flavor package are released from the aerosol generating means of the smoking article during use to provide a flavor and aroma profile. Thus, the flavor package includes a group or groups of flavorants interacting in concert to produce a common set of organoleptic, olfactory and/or gustatory sensory perceptions.

Flavor packages of the present invention include natural flavoring agents, and preferably also include artificial (e.g., synthetic) flavoring agents. Examples of the optional artificial flavoring agents include components of tobacco top dressing formulations, synthetic glycosides; synthetically microencapsulated flavoring agents; certain tobacco flavor modifiers; and the like. Examples of natural flavoring agents include (i) natural materials such as natural flavor extracts and processed natural flavors including cocoa and licorice (e.g., flavor extracts, powders and oils); tobacco such as finely shredded tobacco laminae, tobacco dust, tobacco extracts including spray dried tobacco extracts, tobacco aroma oils and tobacco essences; natural flavoring materials such as sugars, glycosides, and the like; as well as mixtures thereof; and (ii) parts or fragments of at least one essential oil gland bearing plant. Various flavoring agents are set forth in Leffingwell et al, *Tobacco Flavoring For Smoking Products* (1972).

Portions of essential oil gland bearing plants useful in the present invention include (i) a volatile, flavorful portion which provides a complex flavor profile, and (ii) a non-volatile portion which provides minimal flavorful components but functions as a type of encapsulating medium for the volatile components, thus maintaining the complexity of the flavor profile of the volatile portion. In particular, a portion of a suitable essential oil gland bearing plant provides a controlled natural flavor release package. For example, essential oils are naturally encapsulated by membranes or tissues which make up the plant gland, and the membranes or tissues are damaged by physical means such as the application of heat experienced upon use of the smoking article, thereby providing for the release of the essential oils. Typically, essential oils are released from the plant gland upon exposure to a temperature of about 80° C. to about 225° C., normally about 100° C. to about 160° C. As such, the essential oils are released from the plant gland in a manner such as the application of heat, as opposed to the use of a solvent or physical crushing of the gland.

Essential oils are aromatic, volatile substances which provide flavor and aroma. Normally, essential oil bearing plant glands contain, on average, from about 50 to about 300 flavor substances in amounts greater than 1 ppm. Usually, essential oil glands comprise less than about 5 percent, frequently less than about 2 percent of essential oils, based on the total weight of the plant gland. Furthermore, certain essential oil substances act as natural antioxidants, and as such tend to minimize or prevent oxidation and polymerization of other essential oil substances contained within a gland.

Essential oil glands can have various shapes or forms for use according to the present invention. For example, the plant part or fragment which contains the essential oil gland can have the form of a particle, sliver, strand or the like; or a processed form such as a paste or densified pellet. Typically, the plant parts or fragments have a moisture content prior to use of about 8 to about 12 weight percent for use according to the present invention. However, when employed in the preferred cigarette of the present invention, the plant parts or fragments are employed with components such as the substrate, tobacco extracts and aerosol forming substances which collectively have a moisture content of about 3 to about 5 weight percent. Normally, the plant parts or fragments have a particle size less than about 40 mesh, preferably less than about 100 mesh, and more preferably less than about 200 mesh; although the particle size of a particular plant fragment depends upon factors such as the particular plant material and the particular application. Often, the plant portion is ground or shredded to the desired particle size. However, it is desirable that the plant portion not be ground or otherwise divided to the point that an overly large number of the essential oil glands are damaged. As such, a significant amount of the essential oil remains encased inside the membranes which make up the gland. Such naturally encased essential oils then can be released upon damage of the gland by physical means, such as the application of heat, during use of the smoking article.

Essential oil glands are obtained from various parts or organs of plants, depending upon factors such as the species of plant and the character of the essential oil which is desired. For example, essential oil bearing plant glands can be found in the leaf, stalk, bark, stem, root, fruit, arilode, rhizome, rind, flower, bud or calyx of the particular plant which is employed.

Examples of essential oil gland bearing plants include *Laurus nobilis* L. (bay leaf), *Ocimum basilicum* L. (basil), *Rosmarinus officinalis* L. (rosemary), *Origanum vulgare* L. subspecies *hirtum* (Link) Ietswaart and other subspecies (origanum), *Mentha piperita* L. (peppermint), *Cinnamomum zeylanicum* Blume, *Cinnamomum burmannii* (Nees et T. Nees) Blume, *Cinnamomum cassia* J. Presl (cinnamon or cassia), *Levisticum officinate* Koch. (lovage), *Chamomilla recutita* (L.) Rauschert (chamomile), *Pimpinella anisum* L. (anise), *Anethum graveolens* L. (dill), *Pogostemon cablin* (Blanco) Benth. (patchouli), *Juniperus virginiana* L. or *Juniperus ashei* Buchholz (cedarwood), *Piper nigrum* L. (black pepper), *Elettaria cardamomum* (L.) Maton (cardamon), *Thymus vulgaris* L. (Thyme), and the like, as well as mixtures thereof. See *Herbs Spices and Medicinal Plants,* Edit. by Craker and Simon, Vol. 2, pp. 183–240, Oryx Press (1987).

Flavor packages which employ effective amounts of suitable portions of the essential oil gland bearing plants provide complex flavor notes having a large number of essential oil substances. As such, the taste and mouth feel experienced by the user due to the tobacco and other aerosol forming substances of the smoking article is complemented. In particular, the combination of flavors provides a fullness or stimulation to the oral cavity, and body to the overall flavor impression. However, the release of the essential oil substances is provided by the application of heat to the plant gland without burning the plant fragments. Thus, a flavor profile which resembles that of burning tobacco can be provided without the necessity of burning tobacco.

Natural flavors are released in a controlled manner over time upon use of the smoking articles of the present invention. In particular, relatively consistent levels of flavorful substances are released (i) at certain times during use of the smoking article, and (ii) in certain amounts over time. Due to the spacing of the various plant glands within the aerosol generating means and the spacing of the various plant glands from the fuel element, certain plant glands within the aerosol generating means experience higher temperatures than other plant glands over the time period that the smoking article is smoked. Also, the physical nature of the plant glands (i.e., the natural positioning of the glands within the plant), and the fact that types of glands can vary (e.g., thin wall versus thick wall glands within a species or between species), glands can be damaged at various times, temperatures, physical conditions, etc. provides for flavor generation over the time period that the smoking article is smoked. As such, overpowering notes are not provided as is common when extracts are employed as flavoring agents in certain types of smoking articles. For example, tobacco extracts and flavor extracts having a wide range of extracted flavor components often can provide body to a flavor, but also often provide undesirable overpowering notes and are absent of many of the flavor components which are present at low levels in essential oil bearing plant glands.

The flavor delivery packages can be incorporated into the aerosol generating means in a variety of ways. For example, divided plant gland material can be dispersed in a liquid, such as water or glycerin, and applied to the substrate. The substrate which carries the plant material then is incorporated in the aerosol generating means of the smoking article.

The amount of plant gland material which is employed according to the present invention can vary. Typically, the amount of plant gland material employed depends upon factors such as the dispersibility of the material in liquid, placement of material, the threshold strength of essential oils, population density of glands, size of glands, shelf life of the material, stability of the essential oils, and the like. Typically, the amount of essential oil gland bearing plant material employed ranges from about 1 microgram to about 25 milligrams, per smoking article.

For use of the smoking article of the present invention, the fuel element is lighted and burns. The burning fuel element generates heat used to damage the essential oil glands which are positioned physically separate from the fuel element but in a heat exchange relationship with the fuel element, and volatilize essential oils that are released from within the plant glands. The burning fuel element also generates heat sufficient to volatilize tobacco materials, tobacco flavoring agents and other aerosol forming materials within the aerosol generating means. When the user draws on the mouthend of the smoking article, air is drawn into the smoking article, and the volatilized aerosol forming substances, including the essential oils released by the plant glands, pass within the drawn air from the aerosol generating means and into the mouth of the user. As such, the user is provided with many of the pleasures associated with smoking without the necessity of burning tobacco or components of the flavor delivery package.

The following examples are provided in order to further illustrate various embodiments of the invention but should not be construed as limiting the scope thereof. Unless otherwise noted, all parts and percentages are by weight.

EXAMPLE 1

Cigarettes of the type illustrated in FIG. 1 are manufactured in the following manner:

Fuel Source Preparation

A generally cylindrical fuel element 10 mm long and 4.5 mm in diameter, and having an apparent (bulk) density of about 0.86 g/cc is prepared from about 79 parts hardwood pulp carbon, about 10 parts Raven J lampblack unactivated carbon having an average particle size of 0.2 micrometers in diameter, 10 parts Hercules 7HF SCMC binder, and 1 part potassium carbonate.

The hardwood pulp carbon is prepared by carbonizing a non-talc containing grade of Grand Prairie Canadian Kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to a fine powder having an average particle size of about 4 to about 6 microns in diameter.

The finely powdered hardwood carbon is admixed with the lampblack carbon, the sodium carboxymethyl cellulose binder, the potassium carbonate, and sufficient water to provide a mixture having a stiff, dough-like paste form.

Fuel elements are extruded using a ram extruder from the paste so as to have 7 central passageways, each of about 0.021 inch in diameter, and 6 peripheral passageways, each of about 0.01 inch in diameter. The configuration of the passageways or holes which extend longitudinally through the fuel element is shown in FIG. 1B. The inner web thickness, or spacing between the central passageways, is about 0.008 inch; and the average outer web thickness, or spacing between the periphery of the fuel element and the peripheral passageways, is about 0.019 inch. The resulting extrudate are dried in air to provide a resilient extrudate, and the extrudate is cut into 10 ml lengths, thereby providing fuel elements.

The extruded fuel elements are baked-out under nitrogen atmosphere for a 40 minute period so as to reach a temperature of at least 900° C. during the period.

Spray Dried Tobacco Extract

A blend of aged flue-cured tobacco is ground to a medium dust and extracted with water in a stainless steel tank at a concentration of about 1 to about 1.5 pounds tobacco per gallon of water. The extraction is conducted using mechanical agitation at ambient temperature over a period of about 1 to about 3 hours. The tobacco/water admixture then is centrifuged to remove suspended solids. The aqueous tobacco extract is concentrated in a thin film evaporator to a concentration of about 30 percent dissolved tobacco solids. The concentrated aqueous extract then is spray dried by continuously pumping the aqueous solution to an Anhydro Size No. 1 Spray Dryer. The dried powder is collected at the outlet of the spray dryer. The inlet temperature of the spray dryer is about 215° C., and the outlet temperature is about 82° C. The spray dried powder has a moisture content of about 6 to about 8 percent.

Alumina Substrate

Alpha alumina beads are available as D-2 Sintered Alpha Alumina from W. R. Grace & Co. The beads are about 97 percent alpha alumina, and have a surface area of about 4 to about 8 $m^2/g$ as determined using the BET method. The beads have a size from −14 to +20 mesh (U.S.).

Preparation of Flavored Substrate

In a high shear blender is mixed 4 g of the spray dried tobacco extract and 45 g water. The resulting solution is contacted with 70.5 g of the alpha alumina beads in a stainless steel pot fitted with a heating jacket held at about 35° C. The solution is absorbed by the beads, and the beads then are dried to a moisture level of about 1 percent by heating the beads at about 80° C. to about 100° C. in a fluidized dryer.

The dried beads are returned to the pot, and contacted with a mixture of 25 g glycerin and 0.24 g cinnamon bark powder (ground to a mesh size of 80), 0.24 g powdered chamomil flowers (ground to a mesh size of 80) and 0.03 g licorice. The mixture is absorbed by the beads, thereby providing alpha alumina beads carrying tobacco extract, glycerin, cinnamon bark powder, powdered chamomile flowers and licorice. The resulting flavored substrate weighs about 100 g.

Cartridge Assembly

A hollow metal container is manufactured from aluminum using a metal drawing process. The container has a length of about 30 mm, an outer diameter of about 4.5 mm, and an inner diameter of about 4.3 mm. One end of the container is open; and the other end is sealed, except for 2 slot-like openings, which are about 0.65 mm by 3.45 mm in size, and spaced about 1.14 mm apart.

About 340 g of the flavored substrate is loaded into the container. Then, the fuel element is inserted into the open end of the container to a depth of about 3 mm. As such, the fuel element extends about 7 mm beyond the open end of the container.

Insulating Jacket

The assembled fuel element/flavored substrate loaded cartridge is overwrapped, at the fuel element end, with a 10 mm long glass fiber jacket. The glass fiber jacket is Owens-Corning 637 glass having a 3 percent pectin binder. The resulting diameter of the glass fiber jacketed fuel element is about 7.5 mm. The glass jacket is overwrapped with an innerwrap paper material designated as P78-63-5 from Kimberly-Clark Corp.

Tobacco Roll

A tobacco roll consisting of volume expanded Burley tobacco cut filler is wrapped in a paper designated as P1487-125 from Kimberly-Clark Corp., thereby forming a tobacco rod having a diameter of about 7.5 mm and a length of about 22 mm. Insertion of a probe into one end of the tobacco rod provides a longitudinal passageway of about 4.5 mm diameter through the tobacco rod.

Front end Assembly

The container portion of the insulated cartridge assembly is inserted into the passageway in the tobacco roll until the glass fiber jacket abuts one end of the tobacco rod. The overwrapped glass fiber section and the tobacco rod then are joined together by a paper overwrap designated as P1768-182 from Kimberly-Clark Corp., which circumscribes the length of the overwrapped glass fiber section as well as the length of the tobacco rod. The length of the frontend assembly is about 48 mm.

Mouthend Piece

A mouthend piece includes a 10 mm long cylindrical segment of a gathered tobacco paper and a 30 mm long cylindrical segment of a gathered web of non-woven, melt-blown polypropylene, each of which includes an outer paper wrap. Each of the segments are provided by subdividing rods prepared using the apparatus described in U.S. Pat. No. 4,807,809 to Pryor et al.

The first segment is about 7.5 mm in diameter, and is provided from a gathered web of tobacco paper available as P144-B from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as P100 from Kimberly-Clark Corp. which is circumscribed by a paper plug wrap available as P1487-184-2 from Kimberly-Clark Corp.

The two segments are axially aligned in an abutting end-to-end relationship, and are combined by circumscribing the length of each of the segments with a paper overwrap available as P850-186-2 from Kimberly-Clark Corp. The length of the mouthend piece is about 40 mm.

Final Assembly of Cigarette

The frontend assembly is axially aligned in an abutting end-to-end relationship with the mouthend piece, such that the container end of the frontend assembly is adjacent to the gathered tobacco paper segment of the mouthend piece. The frontend assembly is joined to the mouthend piece by circumscribing the length of the mouthpiece and a 5 mm length of the frontend assembly adjacent the mouthend piece with tipping paper available as 30637-801-12001 from Ecusta Corporation.

Use of the Cigarette

For use, the smoker lights the short fuel element with a cigarette lighter and the fuel element burns. The smoker inserts the mouthend of the cigarette into his/her lips, and draws on the cigarette. A visible aerosol having tobacco flavor is drawn into the mouth of the smoker.

EXAMPLE 2

A cigarette of the type described in Example 1 is provided except that the flavored substrate is prepared as follows:

In a high shear blend is mixed 4 g of spray dried tobacco extract and 45 g water. The resulting solution is contacted with 70.7 g of alpha alumina beads in a stainless steel pot with a heating jacket held at about 35° C. The solution is absorbed by the beads, and the beads are dried as described in Example 1.

The dried beads are returned to the pot, and contacted with a mixture of 25 g glycerine containing a mixture of tobacco flavoring agents and 0.3 g powdered chamomile flowers (ground to a mesh size of 80). The mixture is absorbed by the beads, thereby providing alpha alumina beads carrying tobacco extract, glycerin, flavoring agents and powdered chamomile flowers. The resulting flavored substrate weighs about 100 g.

EXAMPLE 3

A cigarette of the type described in Example 1 is provided except that the flavored substrate is prepared as follows:

In a high shear blend is mixed 3 g of spray dried tobacco extract and 45 g water. The resulting solution is contacted with 71.9 g of alpha alumina beads in a stainless steel pot with a heating jacket held at about 35° C. The solution is absorbed by the beads, and the beads are dried as described in Example 1.

The dried beads are returned to the pot, and contacted with a mixture of 25 g glycerine containing a mixture of tobacco flavoring agents and 0.8 g powdered Cardamom (ground to a mesh size of 80). The mixture Is absorbed by the beads, thereby providing alpha alumina beads carrying tobacco extract, glycerin, flavoring agents and powdered Cardamom. The resulting flavored substrate weighs about 100 g.

EXAMPLE 4

A cigarette of the type described in Example 1 is provided except that the flavored substrate is prepared as follows:

In a high shear blend is mixed 3 g of spray dried tobacco extract and 45 g water. The resulting solution is contacted with 71.7 g of alpha alumina beads in a stainless steel pot with a heating jacket held at about 35° C. The solution is absorbed by the beads, and the beads are dried as described in Example 1.

The dried beads are returned to the pot, and contacted with a mixture of 25 g glycerine containing a mixture of tobacco flavoring agents, 0.24 g cinnamon bark (ground to a mesh size of 80) and 0.10 g lovage root (ground to a mesh size of 80). The mixture is absorbed by the beads, thereby providing alpha alumina beads carrying tobacco extract, glycerin, flavoring agents, powdered cinnamon bark and powdered lovage root. The resulting flavored substrate weighs about 100 g.

What is claimed is:

1. A cigarette comprising:
(a) tobacco;
(b) a combustible fuel element; and
(c) an aerosol generating means (i) physically separate from the fuel element and in a heat exchange relationship with the fuel element, and (ii) including a flavor package including tobacco and a portion of an essential oil gland bearing plant which is capable of releasing essential oil substances by the application of heat but without burning.

2. The cigarette of claim 1 wherein the fuel element has a density greater than about 0.5 g/cc and a length less than about 30 mm prior to use.

3. The cigarette of claim 1 wherein the combustible fuel element is a carbonaceous fuel element having a length less than about 30 mm prior to use.

4. The cigarette of claims 1, 2 or 3 wherein the essential oil gland bearing plant is carried by a substrate located in a heat conductive housing in contact with the fuel element.

5. The cigarette of claim 1 wherein the essential oil gland bearing plant includes cinnamon bark.

6. The cigarette of claim 4 wherein the substrate carries a tobacco extract.

7. The cigarette of claim 4 wherein the substrate carries tobacco dust.

8. The cigarette of claim 4 wherein the substrate carries shredded tobacco laminae.

9. The cigarette of claim 4 wherein the substrate further carries cocoa and/or licorice.

10. The cigarette of claim 4 wherein (i) the substrate carries a polyhydric alcohol and a tobacco extract, and (ii) the housing is positioned within and circumscribed by a charge of tobacco cut filler.

11. A cigarette comprising:
(a) tobacco;
(b) a combustible fuel element; and
(c) an aerosol generating means (i) physically separate from the fuel element and in a heat exchange relationship with the fuel element, and (ii) including a portion of an essential oil gland bearing plant in the form of fragments having particle sizes of less than about 40 mesh.

12. The cigarette of claim 11 wherein the essential oil gland bearing plant is carried by a substrate located in a heat conductive housing in contact with the fuel element.

13. The cigarette of claim 12 wherein the substrate carries a tobacco extract.

14. The cigarette of claim 12 wherein the substrate carries tobacco dust.

15. The cigarette of claim 12 wherein the substrate carries shredded tobacco laminae.

16. The cigarette of claim 12 wherein (i) the substrate carries a polyhydric alcohol and a tobacco extract, and (ii) the housing is positioned within and circumscribed by a charge of tobacco cut filler.

17. A smoking article comprising:
(a) a combustible fuel element; and
(b) an aerosol generating means (i) physically separate from the fuel element and in a heat exchange relationship with the fuel element, and (ii) including a flavor package including tobacco and a portion of an essential oil gland bearing plant which is capable of releasing essential oil substances by the application of heat but without burning.

18. The smoking article of claim 17 wherein the fuel element has a density greater than about 0.5 g/cc and a length less than about 30 mm prior to use.

19. The smoking article of claim 17 wherein the combustible fuel element is a carbonaceous fuel element having a length less than about 30 mm prior to use.

20. The smoking article of claims 17, 18 or 19 wherein the essential oil gland bearing plant is carried by a substrate located in a heat conductive housing in contact with the fuel element.

21. The smoking article of claim 20 wherein the substrate carries a tobacco extract.

22. The smoking article of claim 20 wherein (i) the substrate further carries a polyhydric alcohol and a tobacco extract, and (ii) the housing is positioned within and circumscribed by a charge of tobacco cut filler.

23. The smoking article of claim 19 wherein the substrate carries tobacco dust.

24. The smoking article of claim 19 wherein the substrate carries shredded tobacco laminae.

25. A smoking article comprising:
(a) tobacco;
(b) a combustible fuel element; and
(c) an aerosol generating means (i) physically separate from the fuel element and in a heat exchange relationship with the fuel element, and (ii) including a portion of an essential oil gland bearing plant in the form of fragments having particle sizes of less than about 40 mesh.

26. A smoking article comprising:
(a) a combustible fuel element; and
(b) an aerosol generating means (i) physically separate from the fuel element and in a heat exchange relationship with the fuel element, and (ii) including a flavor package including tobacco and a portion of an essential oil gland bearing plant which releases essential oil substances by the application of heat but without burning, and is in the form of fragments having particle sizes of less than about 40 mesh.

27. The smoking article of claim 26 wherein the tobacco is in the form of a tobacco extract.

28. The smoking article of claim 26 wherein the tobacco is in the form of tobacco dust.

29. The smoking article of claim 26 wherein the tobacco is in the form of shredded tobacco laminae.

* * * * *